United States Patent [19]

Ponds et al.

[11] Patent Number: 4,868,727

[45] Date of Patent: Sep. 19, 1989

[54] LIGHT FIXTURE WITH INTEGRAL REFLECTOR AND SOCKET SHIELD

[75] Inventors: Kevin W. Ponds; John E. Calloway, both of Houston, Tex.

[73] Assignee: Innovative Controls, Inc., Houston, Tex.

[21] Appl. No.: 294,286

[22] Filed: Jan. 6, 1989

[51] Int. Cl.[4] ..... F21V 7/00

[52] U.S. Cl. ..... 362/344; 362/223; 362/310; 362/350; 362/374

[58] Field of Search ..... 362/217, 223, 298, 300, 362/304, 310, 344, 346, 374, 349

[56] References Cited

U.S. PATENT DOCUMENTS 4,390,114 6/1983 Sviatoslavsky et al. ..... 362/260
4,410,931 10/1983 DeCandia et al. ..... 362/267

OTHER PUBLICATIONS

Photograph of General Electric 300 Watt Quartz Halogen Floodlight.
Photograph of 300 Watt Quartz Halogen Security Light by Lights of America, Model #3030.

*Primary Examiner*—Stephen F. Husar
*Attorney, Agent, or Firm*—Vaden, Eickenroht, Thompson & Boulware

[57] ABSTRACT

A lighting fixture is disclosed for accommodating a bulb parallel to its opening and that has a reflector made from a thin metal sheet located behind the bulb. At each socket housing location, the reflector is slit and an arc piece is formed from the released metal segment. The arc piece forms an effective shield over the socket and related components. Thus, the reflector and shield or shields are formable in a single action stamping step by appropriate manufacturing equipment.

8 Claims, 2 Drawing Sheets

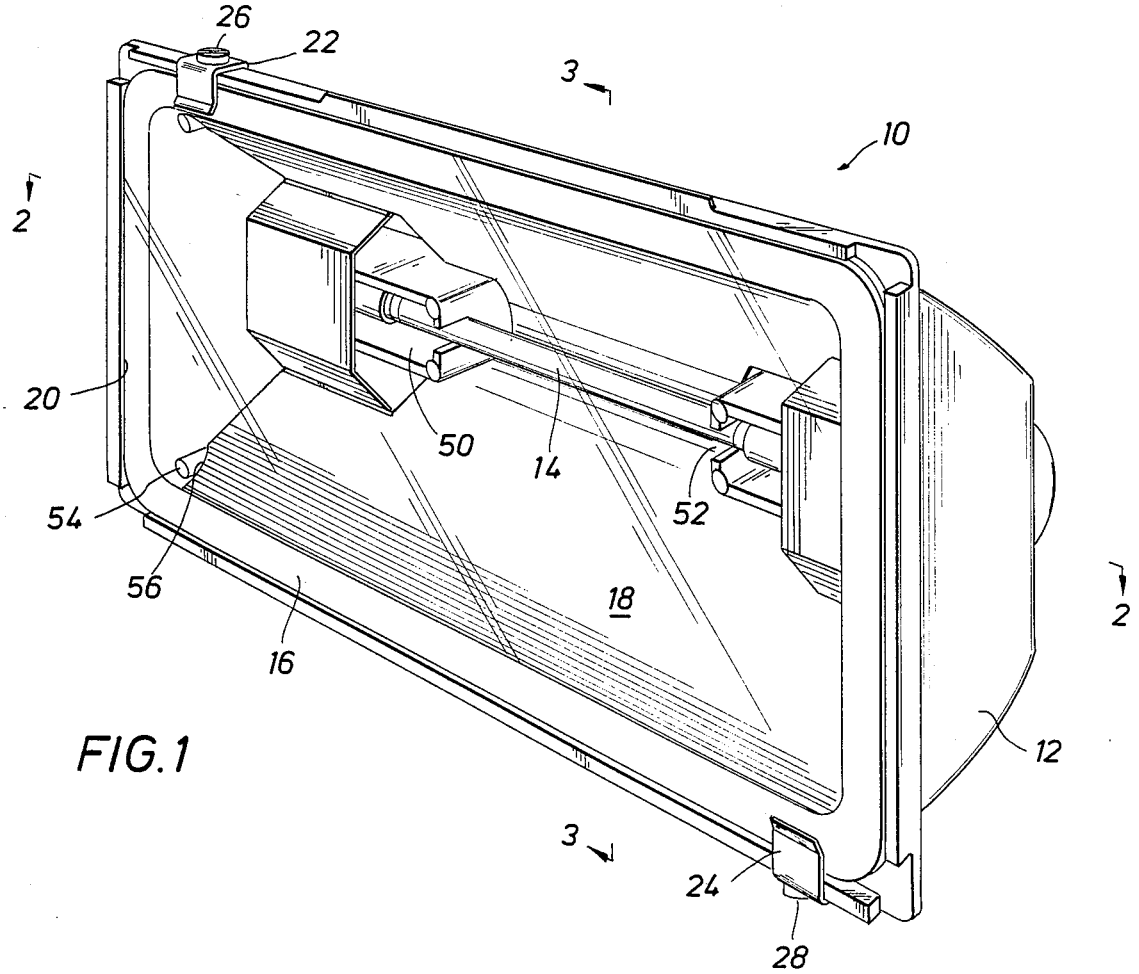
FIG. 1
FIG. 2
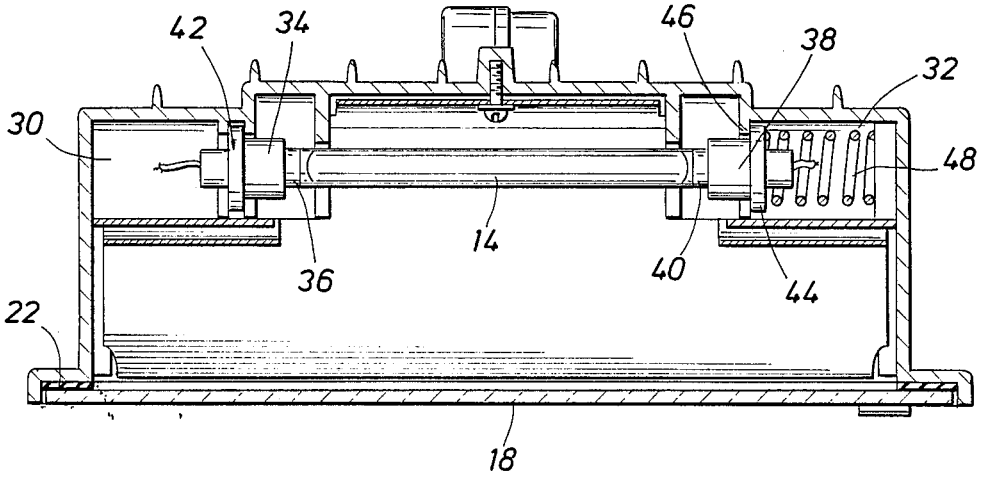

FIG. 3
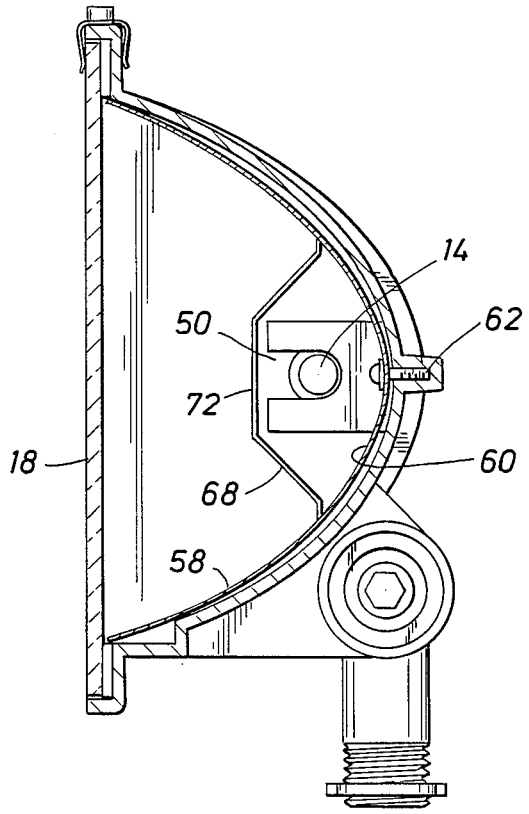
FIG. 4
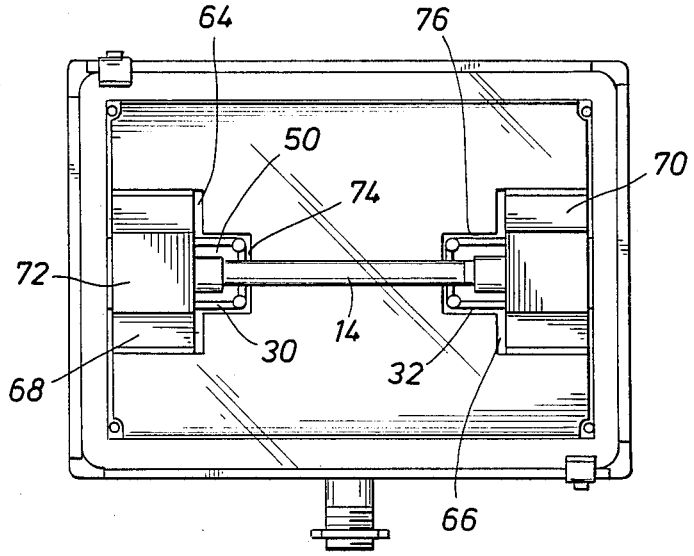
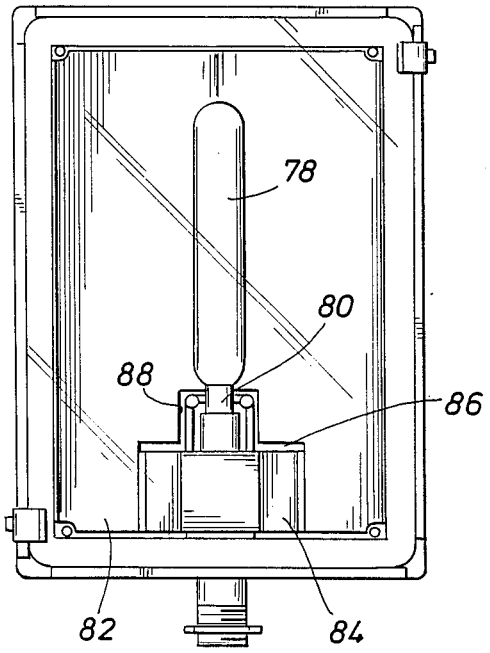
FIG. 5

LIGHT FIXTURE WITH INTEGRAL REFLECTOR AND SOCKET SHIELD

BACKGROUND OF THE INVENTION

1. Field of the Invention

This invention pertains to lighting fixtures and their reflectors and particularly to such fixtures typically housing a quartz or halogen lamp.

2. Description of the Prior Art

Lighting fixtures, such as are used for outdoor security lighting purposes, typically house an elongated quartz or halogen lamp bulb. Such a lamp bulb, being elongated, is mounted in its housing so that its elongated axis is parallel with the plane of the window opening through which light shines. Some lamp bulbs of this type have connectors at both ends and some have a connector only at one end. In either case, however, since the long axis of the bulb is parallel to the plane of the opening, this means that the axis of the receiving sockets or socket is also parallel to such plane. The lamp bulb in such a fixture is installed in its sockets or socket by first removing or opening the window of the fixture and manipulating the bulb into its sockets or socket. In some cases, the connector ends are of the bayonet type and in other cases they are of the screw type. In either event, the seating of the ends in an appropriate socket is critical and bulb rotation is required. All of this requires some dexterity on the part of the bulb installer.

It has been recognized that since the socket connectors or connector has to be located in the places or place just described, the reflector has heretofore had to be cut out to go around each of such sockets. Typically, a reflector is made of curvilinear, somewhat flexible and highly reflective metallic material, such as polished aluminum. The reflector fits into the housing of the fixture and is secured at at least one point, for example, by means of a screw and a centrally located screw hole in the reflector and an accommodating hole in the housing. In order to fit snugly into the housing and behind the bulb, such a reflector has been cut out or notched to permit the reflector to fit around the sockets or socket. However, such bare or uncovered sockets are both unsightly, diminish reflectivity, and are somewhat hazardous to the installer. That is, there is a possibility that the installer could receive a shock from a bare socket. Therefore, it has been customary to provide each socket with an appropriate cover or shield. This is done by installing a small plate with the same or comparable finish as the reflector by means of a screw, a screw hole in such shield and a matching screw hole in the housing compartment formed about the socket. In the case of two sockets, each socket is covered by its own shield in the manner just described.

In manufacturing the parts of a fixture having the parts just described, it has heretofore been necessary to have a minimum of a reflector, a shield for each connector and a screw for each part. This is obviously a more expensive arrangement to manufacture and assemble than if the reflector were to serve as both reflector and socket shield. Also, separate parts tend to become disconnected and lost after a fixture is put into service, making it further desirable to eliminate the shields as separate parts.

However, it has not been previously possible to eliminate the shields and still manufacture the parts in an economic fashion. The shield in the prior art are flat pieces of metal easily stamped out by production equipment. The reflector starts out as a flat piece of metal that is stamped out in the desired shape and then curved. To build the shields or shield into the reflector has not heretofore appeared to be possible in a economically produced structure.

Therefore, it is a feature of the present invention to provide a simple lighting fixture having need for one or more socket shields with a unitary reflector and shield structure that can be readily manufactured in a simple manner.

SUMMARY OF THE INVENTION

The invention involves a lamp fixture that accommodates an elongated lamp bulb parallel to its window opening. The housing of the fixture includes one or two socket compartments (dependent on whether the bulb is of the one or two terminal connector type), each compartment having a front side opening into which the electrical socket is placed and for accommodating the insertion of the bulb. The reflector is made of a thin sheet of metal curvilinearly shaped to fit behind the bulb in the housing. At each socket compartment, there is an accommodated, partly exposed electrical socket. axis of the bulb position and the partly separated metal is bent forward to form an arc that vaultly fits over all or most of the socket compartment when the reflector is in position.

BRIEF DESCRIPTION OF THE DRAWINGS

So that the manner in which the above-recited features, advantages and objects of the invention, as well as others which will become apparent, are attained and can be understood in detail, a more particular description of the invention briefly summarized above may be had by reference to the embodiments thereof that are illustrated in the drawings, which drawings form a part of the specification. It is to be noted, however, that the appended drawings illustrate only preferred embodiments of the invention and are, therefore, not to be considered limiting of its scope, for the invention may admit to other equally effective embodiments.

IN THE DRAWINGS

FIG. 1 is an oblique pictorial view of a lighting fixture with reflector in accordance with a first preferred embodiment of the invention.

FIG. 2 is a top cross sectional view of the lighting fixture shown in FIG. 1 taken at line 2—2.

FIG. 3 is a side cross sectional view of the lighting fixture shown in FIG. 1 taken at line 3—3.

FIG. 4. is a front view of the lighting fixture shown in FIG. 1.

FIG. 5 is a front view of a second preferred embodiment of the invention.

DESCRIPTION OF THE PREFERRED EMBODIMENTS

Now referring to the drawings and first to FIG. 1, a lighting fixture or luminaire 10 in accordance with a preferred embodiment of the invention, is shown in an oblique, pictorial view. Generally, the lighting fixture includes a housing 12 for accommodating an elongated lamp bulb 14 parallel to window opening 16. Window opening 16 is covered by a lens 18 that is slightly larger than opening 16 and accommodated within a recess 20 around the outer periphery of the housing. A flat gasket 22 is retained in recess 20 and lens 18 is held in place by holding clamps 24 and 26 at alternate corners of the fixture. These clamps are held in place by screws 26 and 28, although other arrangements can be provided.

Within the housing there are two connector compartments built into the housing casing, namely compartments 30 and 32. Compartment 30 is located on the left side of FIG. 1 and accommodates therein an appropriate socket or socket connection 34 for receiving a first terminal connecting end 36 of bulb 14. In like fashion, compartment 32 accommodates socket connector 38 which, in turn, accommodates terminal connector 40 of the bulb. In the embodiment shown, it will be seen that socket 34 has an enlarged collar portion 42 that slips into an accommodating recess of compartment 30. Socket 38 also includes an enlarged collar 44 that is constrained against movement in a left axial direction by lip or projection 46 in compartment 32. Spring 48 urges socket 38 in a left direction by being placed under compression within the right hand portion of compartment 32.

It may be seen that bulb 40 is placed in position during installation by first placing terminal connector 40 within socket 38 and compressing spring 32 so that terminal connector 36 can be accommodated by socket 34. The installer then releases the compression pressure on spring 32 to allow the bulb to be firmly seated into the sockets. In some cases, rotation of the bulb is also required depending on the shape of the terminal connectors and the receiving sockets.

Although FIG. 2 illustrates only one spring, each socket 38 and 42 can be supported by an accommodating spring urging the respective connector toward the center of the fixture, if desired.

Returning to FIG. 1, it may been seen that compartments 30 and 32, respectively, include side openings 50 and 52 to allow bulb 14 to be inserted, as described above.

Now referring to the internal construction of the housing, it should be noted that at each corner of the housing there is a cast corner enlargement 54 so that a thin metal reflector, to be described more precisely hereafter, can be accommodated by corresponding corner notches 56 to insure accurate placement of the reflector.

As may be best seen in FIG. 3, reflector 58 is made of a thin metal material, such as polished aluminum, to provide an appropriate reflective surface. The metal is curved in an appropriate curvilinear shape, usually hyperbolic or parabolic, so that the main or center portion of reflector 56 forms a reflective surface area. The center portion 60 of the reflector is located behind bulb 14. Where the reflector contacts the housing, a centrally located hole in reflector 58 and an accommodating matching hole in the housing allows the reflector to be secured in place by screw 62. The hole in the housing is appropriately internally threaded to receive the threads of screw 62.

In the vicinity of the connector compartments in the housing, reflector 58 is slit at slit 64 and 66, respectively. Each of these slits is transverse to the axis of the bulb to be received so as to allow the reflector material to be bend forward in an arcuate shape to form vault-like shields 68 and 70, respectively, at the two ends of the reflector. It should be noted that these respective arc pieces 68 and 70 are formed so that there are bent flat segments with appropriate intervening bends, rather than a curvilinear surface, as best shown in FIG. 3. The center section of arc piece 68 is section 72, which is parallel to lens 18. It may been seen that such surface conveniently protects most of the open compartment 50 therebehind so as to shield the wires, spring, any bare parts of the socket and in some cases even a portion of the terminal connector of the bulb, while providing a shiny reflective surface for secondary reflections.

In may be seen that in the manufacture of a reflector of the shape just described, the length of arc piece 68 or 70 is the same length as the curvilinear reflector portion from which it is made. The design is such that even though arc piece 68 is in straight or flat segments, it does not have to be separately made from another piece of metal that is attached to the base reflector. Such dimensioning is easily accommodated by automated stamping and metal bending equipment and can be performed with an appropriately shaped die in a single action.

Returning to the shape of reflector 58, axial cut-outs 74 and 76 are removed from the reflectors progressing from notches 64 and 66, respectively, so as to allow the reflector to snugly fit over the extension or exposed portions of socket compartments 30 and 32.

Another embodiment of the invention is shown in FIG. 5. In this embodiment, the elongated bulb accommodated by the fixture is bulb 78, which is of the type that has a single connector terminal 80 only on one end. A bulb of this shape is usually accommodated in an elongated housing oriented in the vertical direction, rather than in an elongated housing oriented in the horizontal direction, such as for the first embodiment. The reflector shield 82 shown in FIG. 5 includes an arc piece 84 made from an axially transverse slit 86 to permit the formation of a vault-like arc shield 84 of the same type as for the first embodiment. A cut-out 88 from slit 86 is large enough to accommodate the socket compartment of the housing of this fixture, again in the same manner as for the first embodiment.

It should be noted that elongated bulbs 14 and 78 are usually respectively equipped with bayonet type terminal connectors and a screw type terminal connector, respectively. However, alternate connectors and their accommodating sockets are available. The invention is not limited to the type of connector or connectors affixed to the respective bulbs or to the resulting shape of the receiving sockets.

While preferred embodiments of the invention have been shown and described, and some modifications or alternatives have been discussed, it will be understood that this invention is not limited thereto since modifications can be made and will become apparent to those skilled in the art.

What is claimed is:

1. A curvilinearly thin metal reflector for fitting in the housing of a light fixture so as to be located behind an accommodated elongated light bulb having its axis aligned parallel with the window opening of the fixture, including:

a transverse slit with respect to the axis of the bulb to be accommodated; and an arc piece defined by said slit that is vaultly bent over the front side of an accommodating socket compartment in the housing for receiving the bulb.

2. A thin metal reflector in accordance with claim 1, and including:

a second transverse slit with respect to the axis of the bulb to be accommodated; and a second arc piece defined by said second slit that is vaultly bent over the front side of a second accommodating socket compartment in the housing for receiving the bulb.

3. A thin metal reflector in accordance with claim 1, wherein the reflector is cut out from said slit toward the center of the reflector to fit snugly over an extension of the socket compartment of the housing not covered by said arc piece.

4. A lamp fixture for accommodating an elongated lamp bulb parallel with the fixture opening, comprising:

a housing including at least one built-in socket compartment for accommodating an electrical socket for receiving an end terminal connector of the bulb, said socket compartment having at least a partial opening on its front side for accommodating the insertion of the bulb; and a thin metal reflector curvilinearly shaped to fit into said housing to be located behind the bulb and having a portion thereof transversely slit with respect to the axis of the bulb to define an arc piece of said reflector that is vaultly bent over at least most of the front side opening of said socket.

5. A lamp fixture in accordance with claim 4, wherein:

said socket compartment includes an extension along the elongated axis of the bulb toward the center of said reflector so as not to be covered by said arc piece; and said reflector is axially cut out from said slit toward the center of said reflector to fit snugly over the extension of said socket compartment.

6. A lamp fixture in accordance with claim 4, wherein the length of arc piece vaultly bent forward is equal in length to the curvilinear reflector from which it is taken.

7. A lamp fixture for accommodating an elongated lamp bulb parallel with the fixture opening, the lamp having a first terminal connector on its first end and a second terminal connector on its second end, comprising:

a housing including a first built-in socket compartment for accommodating a first electrical socket for receiving the first end terminal connector of the bulb, said first socket compartment having at least a partial opening on its front side for accommodating the insertion of the bulb;

said housing including a second built-in socket compartment for accommodating a second electrical socket for receiving the second end terminal connector of the bulb, said second socket compartment having at least a partial opening on its front side for accommodating the insertion of the bulb; and a thin metal reflector curvilinearly shaped to fit into said housing to be located behind the bulb and including a first transverse slit with respect to the axis of the bulb to define a first arc piece of said reflector that is vaultly bent over at least most of the front side opening of said first socket;

said reflector including a second transverse slit with respect to the axis of the bulb to define a second arc piece of said reflector that is vaultly bent over at least most of the front side opening of said second socket.

8. A lamp fixture in accordance with claim 7, wherein:

said first socket compartment includes an extension along the elongated axis of the bulb toward the center of the reflector so as not to be covered by said first arc piece;

said reflector is axially cut out from said first slit toward the center of said reflector to fit snugly over the extension of said first socket compartment;

said second socket compartment includes an extension along the elongated axis of the bulb toward the center of the reflector so as not to be covered by said second arc piece; and said reflector is axially cut out from said second slit toward the center of said second reflector to fit snugly over the extension of said second socket compartment.

* * * * *